US009022737B2

(12) United States Patent
Piggush et al.

(10) Patent No.: US 9,022,737 B2
(45) Date of Patent: May 5, 2015

(54) AIRFOIL INCLUDING TRENCH WITH CONTOURED SURFACE

(75) Inventors: Justin D. Piggush, LaCrosse, WI (US); Atul Kohli, Tolland, CT (US)

(73) Assignee: United Technologies Corporation, Hartford, CT (US)

( * ) Notice: Subject to any disclaimer, the term of this patent is extended or adjusted under 35 U.S.C. 154(b) by 874 days.

(21) Appl. No.: 13/205,207

(22) Filed: Aug. 8, 2011

(65) Prior Publication Data

US 2013/0039777 A1 Feb. 14, 2013

(51) Int. Cl.
*F01D 5/18* (2006.01)

(52) U.S. Cl.
CPC ..... *F01D 5/186* (2013.01)

(58) Field of Classification Search
CPC ..... F01D 5/186
USPC ..... 415/115, 116; 416/96 R, 97 A, 97 R; 29/889.721
See application file for complete search history.

(56) References Cited

U.S. PATENT DOCUMENTS

| | | | | |
|---|---|---|---|---|
| 4,676,719 | A * | 6/1987 | Auxier et al. | 416/97 R |
| 5,097,660 | A | 3/1992 | Shekleton | |
| 5,253,976 | A | 10/1993 | Cunha | |
| 5,419,681 | A | 5/1995 | Lee | |
| 5,458,461 | A | 10/1995 | Lee et al. | |
| 5,690,473 | A | 11/1997 | Kercher | |
| 6,050,777 | A | 4/2000 | Tabbita et al. | |
| 6,099,251 | A | 8/2000 | LaFleur | |
| 6,164,912 | A * | 12/2000 | Tabbita et al. | 416/97 R |
| 6,210,112 | B1 | 4/2001 | Tabbita et al. | |
| 6,234,755 | B1 | 5/2001 | Bunker et al. | |
| 6,932,572 | B2 * | 8/2005 | Kohli et al. | 416/97 R |
| 6,955,522 | B2 | 10/2005 | Cunha et al. | |
| 6,994,521 | B2 | 2/2006 | Liang | |
| 7,300,252 | B2 | 11/2007 | Liang | |
| 7,540,712 | B1 | 6/2009 | Liang | |
| 7,690,893 | B2 | 4/2010 | Cunha | |
| 2003/0007864 | A1 * | 1/2003 | Shelton et al. | 415/115 |
| 2010/0040478 | A1 * | 2/2010 | Abdel-Messeh et al. | 416/97 R |
| 2010/0150733 | A1 | 6/2010 | Abdel-Messeh et al. | |

FOREIGN PATENT DOCUMENTS

| | | |
|---|---|---|
| EP | 0924384 A2 | 6/1999 |
| EP | 0924382 A2 | 1/2005 |

* cited by examiner

*Primary Examiner* — Igor Kershteyn
(74) *Attorney, Agent, or Firm* — Kinney & Lange, P.A.

(57) ABSTRACT

An airfoil has a wall, a cooling channel, a trench, and a plurality of cooling holes. The wall has a leading edge, a trailing edge, a pressure side, a suction side, an outer diameter end, and an inner diameter end to define an interior. The cooling channel extends radially through the interior of the wall between the pressure side and the suction side and along the leading edge. The trench extends radially along an exterior of the wall at the leading edge and is recessed axially into the leading edge to form a back wall. The back wall is contoured to include at least one undulation. The plurality of cooling holes extends through the back wall of the trench to connect the interior of the wall at the cooling channel to the exterior.

29 Claims, 4 Drawing Sheets

AIRFOIL INCLUDING TRENCH WITH CONTOURED SURFACE

BACKGROUND

Gas turbine engines operate by passing a volume of high energy gases through a plurality of stages of vanes and blades, each having an airfoil, in order to drive turbines to produce rotational shaft power. The shaft power is used to drive a compressor to provide compressed air to a combustion process to generate the high energy gases. Additionally, the shaft power is used to drive a generator for producing electricity. In order to produce gases having sufficient energy to drive the compressor or generator, it is necessary to combust the air at elevated temperatures and to compress the air to elevated pressures, which again increases the temperature. Thus, the vanes and blades are subjected to extremely high temperatures, often times exceeding the melting point of the alloys comprising the airfoils.

In order to maintain the airfoils at temperatures below their melting point it is necessary to, among other things, cool the airfoils with a supply of relatively cooler bypass air, typically bleed from the compressor. The bypass cooling air is directed into the blade or vane to provide impingement and film cooling of the airfoil. Specifically, the bypass air is passed into the interior of the airfoil to remove heat from the alloy, and subsequently discharged through cooling holes to pass over the outer surface of the airfoil to prevent the hot gases from contacting the vane or blade directly. Various cooling air patterns and systems have been developed to ensure sufficient cooling of the leading edges of blades and vanes.

Typically, each airfoil includes a plurality of interior cooling channels that extend through the airfoil and receive the cooling air. The cooling channels typically extend through the airfoil from the inner diameter end to the outer diameter end such that the air passes out of the airfoil. In other embodiments, a serpentine cooling channel winds axially through the airfoil. Cooling holes are placed along the leading edge, trailing edge, pressure side and suction side of the airfoil to direct the interior cooling air out to the exterior surface of the airfoil for film cooling. The leading edge is subject to particularly intensive heating due to the head-on impingement of high energy gases. The head-on impingement may result in stagnation of air at the leading edge, increasing the mixing out of cooling air from leading edge cooling holes. In order to improve cooling effectiveness at the leading edge, a trench has been positioned at the leading edge in various prior art designs, such as disclosed in U.S. Pat. No. 6,050,777 to Tabbita et al., which is assigned to United Technologies Corporation. The trench allows the cooling air to spread radially before mixing with the turbine gases and eventually spreading out over the outer surfaces of the airfoil. There is a continuing need to improve cooling of turbine airfoil leading edges to increase the temperature to which the airfoils can be exposed to increase the efficiency of the gas turbine engine.

SUMMARY

The present invention is directed toward an airfoil. The airfoil comprises a wall, a cooling channel, a trench and a plurality of cooling holes. The wall has a leading edge, a trailing edge, a pressure side, a suction side, an outer diameter end and an inner diameter end to define an interior. The cooling channel extends radially through the interior of the wall between the pressure side and the suction side and along the leading edge. The trench extends radially along an exterior of the wall at the leading edge and is recessed axially into the leading edge to form a back wall. The back wall is contoured to include at least one undulation. The plurality of cooling holes extends through the back wall of the trench to connect the interior of the wall at the cooling channel to the exterior.

DETAILED DESCRIPTION

Figure 1:
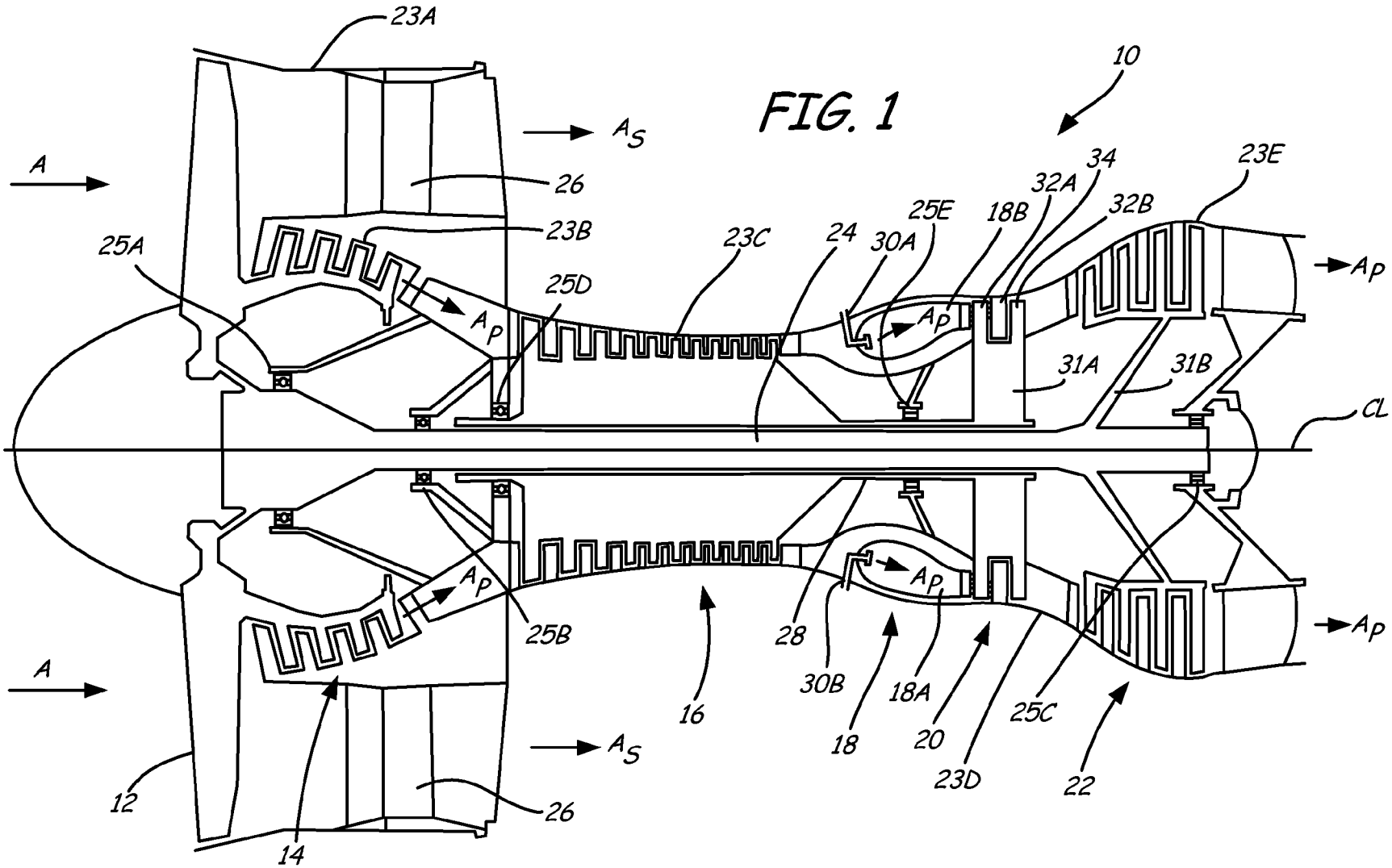
FIG. 1 shows a gas turbine engine including a turbine section in which blades having leading edge trenches with contoured cooling hole surfaces of the present invention are used.

FIG. 1 shows gas turbine engine 10, in which the leading edge trench of the present invention may be used. Gas turbine engine 10 comprises a dual-spool turbofan engine having fan 12, low pressure compressor (LPC) 14, high pressure compressor (HPC) 16, combustor section 18, high pressure turbine (HPT) 20 and low pressure turbine (LPT) 22, which are each concentrically disposed around longitudinal engine centerline CL. Although depicted as a turbofan gas turbine engine in the disclosed non-limiting embodiment, it should be understood that the concepts described herein are not limited to use with turbofans as the teachings may be applied to other types of engines.

Fan 12 is enclosed at its outer diameter within fan case 23A. Likewise, the other engine components are correspondingly enclosed at their outer diameters within various engine casings, including LPC case 23B, HPC case 23C, HPT case 23D and LPT case 23E such that an air flow path is formed around centerline CL.

Inlet air A enters engine 10 and it is divided into streams of primary air $A_P$ and secondary air $A_S$ after it passes through fan 12. Fan 12 is rotated by low pressure turbine 22 through shaft 24 to accelerate secondary air $A_S$ (also known as bypass air) through exit guide vanes 26, thereby producing a major portion of the thrust output of engine 10. Shaft 24 is supported within engine 10 at ball bearing 25A, roller bearing 25B and roller bearing 25C. primary air $A_P$ (also known as gas path air) is directed first into low pressure compressor (LPC) 14 and then into high pressure compressor (HPC) 16. LPC 14 and HPC 16 work together to incrementally step up the pressure of primary air $A_P$. HPC 16 is rotated by HPT 20 through shaft 28 to provide compressed air to combustor section 18. Shaft 28 is supported within engine 10 at ball bearing 25D and roller bearing 25E. The compressed air is delivered to combustors 18A and 18B, along with fuel through injectors 30A and 30B, such that a combustion process can be carried out to produce the high energy gases necessary to turn turbines 20 and 22. Primary air $A_P$ continues through gas turbine engine 10 whereby it is typically passed through an exhaust nozzle to further produce thrust.

HPT 20 and LPT 22 each include a circumferential array of blades extending radially from discs 31A and 31B connected to shafts 28 and 24, respectively. Similarly, HPT 20 and LPT 22 each include a circumferential array of vanes extending radially from HPT case 23D and LPT case 23E, respectively. Specifically, HPT 20 includes blades 32A and 32B and vane 34. Blades 32A and 32B and vane 34 include internal passages into which compressed air from, for example, LPC 14 is directed to providing cooling relative to the hot combustion gasses. Blades 32A include leading edge trenches having contoured cooling hole surfaces of the present invention to improves adherence of cooling air to leading edges of the blades before mixing with primary air A.

Figure 2:
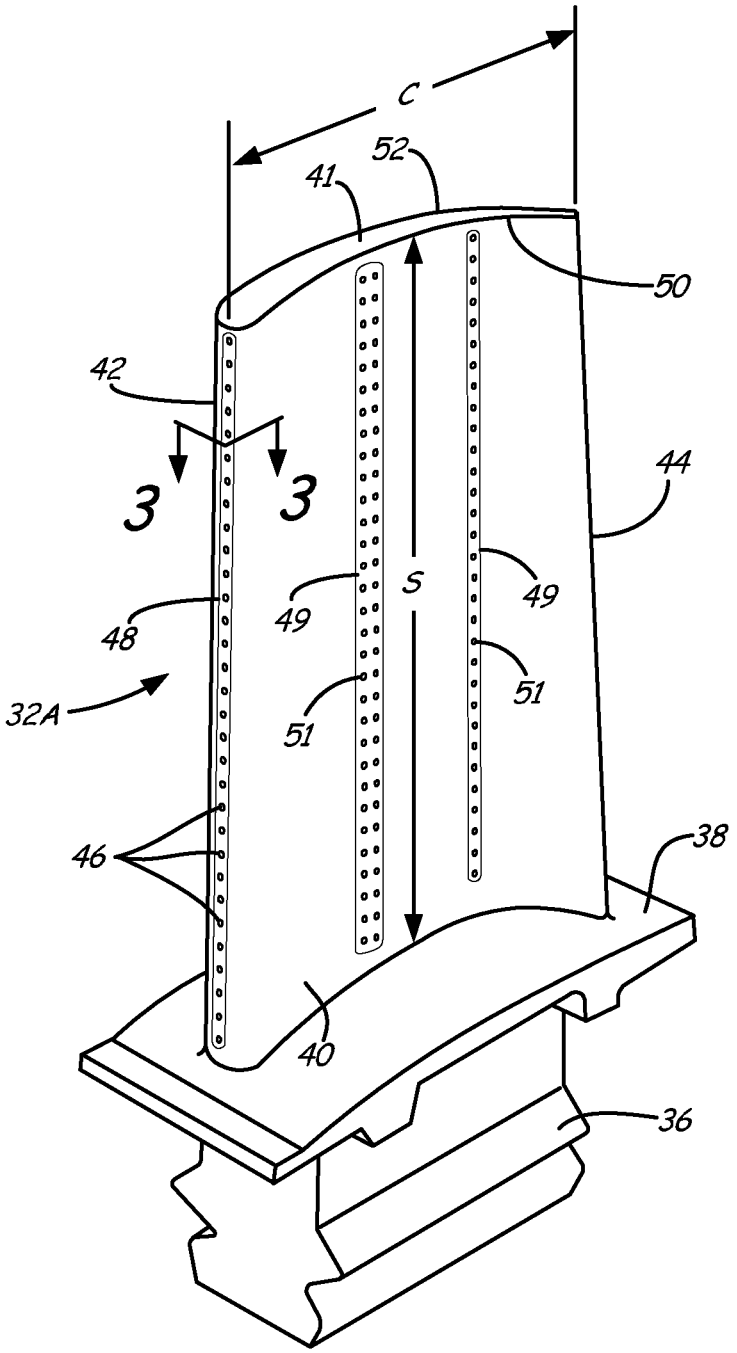
FIG. 2 is a perspective view of a blade used in the turbine section of FIG. 1 showing the leading edge trench extending across a span of the airfoil.

FIG. 2 is a perspective view of blade 32A of FIG. 1. Blade 32A includes root 36, platform 38 and airfoil 40. The span of airfoil 40 extends radially from platform 28 along axis S to tip 41. Airfoil 40 extends generally axially along platform 38 from leading edge 42 to trailing edge 44 across chord length C. Root 36 comprises a dovetail or fir tree configuration for engaging disc 31A (FIG. 1). Platform 38 shrouds the outer radial extent of root 36 to separate the gas path of HPT 20 from the interior of engine 10 (FIG. 1). Airfoil 40 extends from platform 38 to engage the gas path. Airfoil 40 includes leading edge cooling holes 46, leading edge trench 48, pressure side 50 and suction side 52. Airfoil 40 also includes various cooling holes along trailing edge 44, pressure side 50 and suction side 52. Trenches of the type disclosed herein may also be used on pressure side 50 and suction side 52. For example, pressure side 50 includes trenches 49 in which are disposed cooling holes 51. In other embodiments, multiple columns of cooling holes or staggered arrays of cooling holes can be provided in a single trench. As such, multiple trenches can be positioned on leading edge 42, trailing edge 44, pressure side 50 and suction side 52; each trench can have multiple rows of cooling holes positioned with respect to the contours of the present invention.

Typically, cooling air is directed into the radially inner surface of root 36 from, for example, HPC 16 (FIG. 1). The cooling air is guided out of cooling holes 46, which can be angled radially forward within trench 48 with respect to the spanwise direction S, as shown in FIG. 4. As shown, trench 48 extends span-wise across leading edge 42 from just above platform 38 to just below tip 41. In other embodiments, trench 48 may extend spanwise across only a portion of the leading edge. As discussed with reference to FIG. 3, trench 48 is configured to envelope a radial stagnation line across airfoil 40 that develops from interaction of primary air Ap and cooling air $A_C$ (FIG. 1). Trench 48, however, can be located along other radial positions on airfoil 40 wherever cooling holes are used, such as along columns of cooling holes on suction side 52 or pressure side 50 used for film cooling. Trench 48 includes a base through which cooling holes 46 extend that undulates in the radial direction, as discussed with reference to FIG. 4. The undulations guide cooling air exiting cooling holes 46 along trench 48 in the radial direction.

Figure 3:
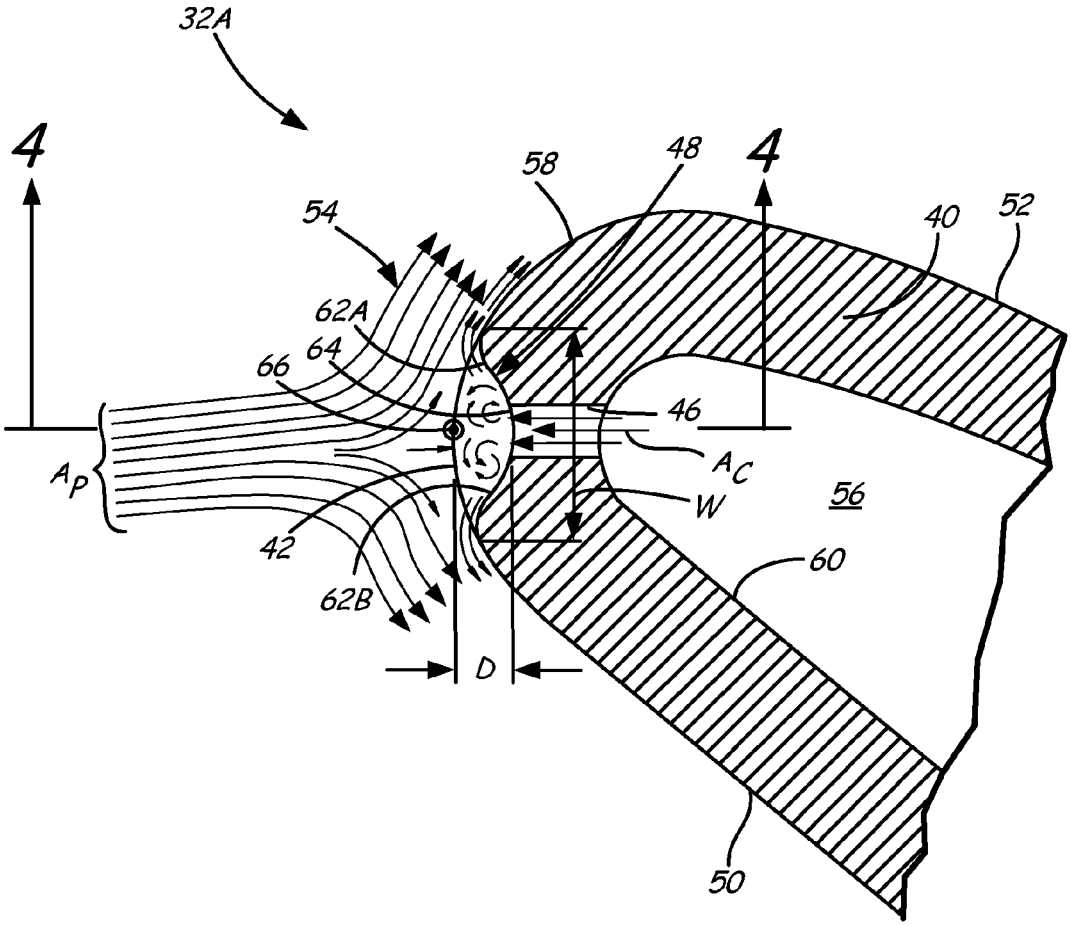
FIG. 3 is a top cross-sectional view of the blade of FIG. 2 showing a cooling hole extending through a contoured surface of the leading edge trench.
Figure 4:
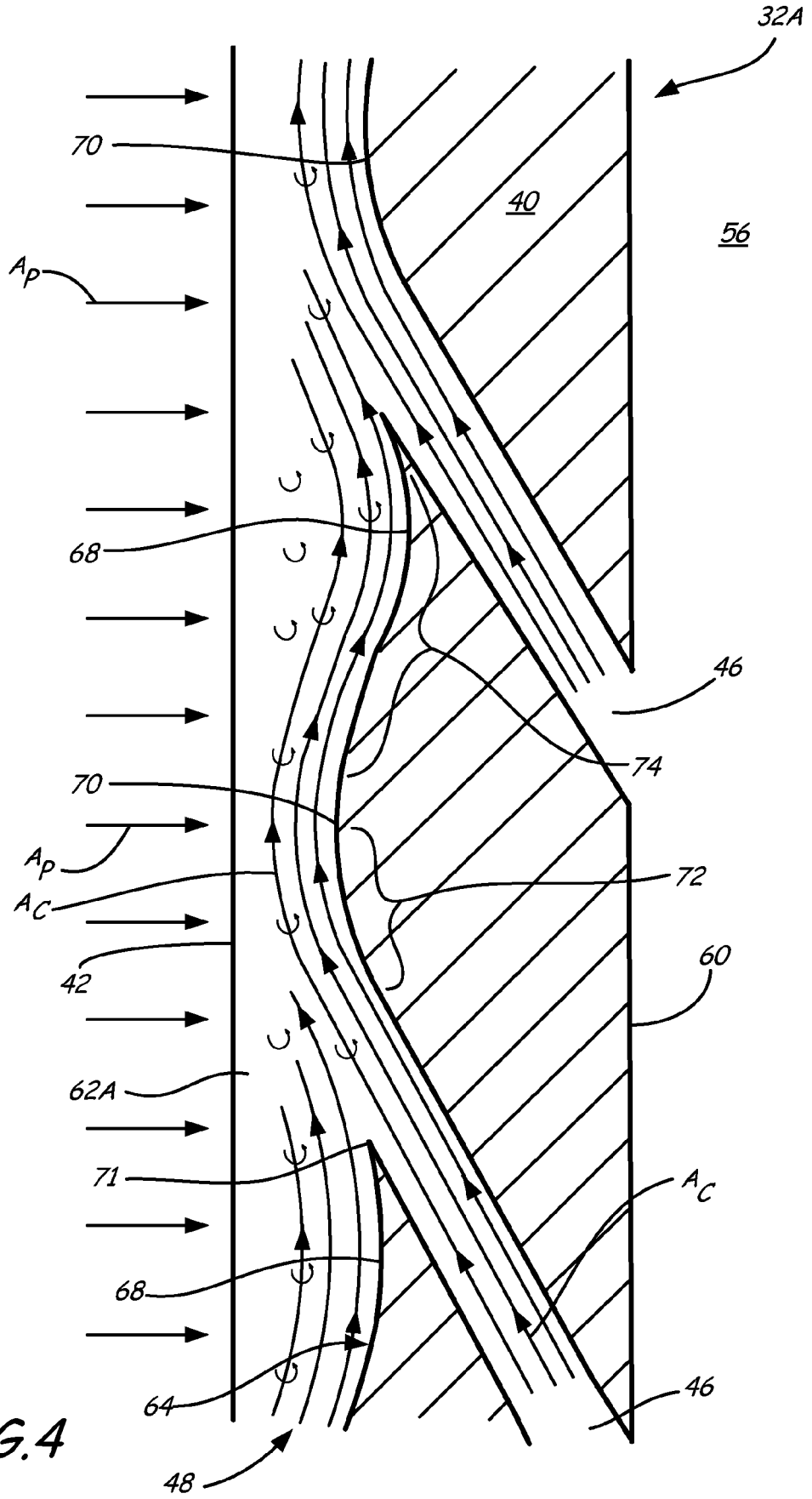
FIG. 4 is a side cross-sectional view of the blade of FIG. 3 showing a series of radially extending undulations comprising the contoured surface of the leading edge trench.

FIG. 3 is a top cross-sectional view of blade 32A of FIG. 2 showing leading edge trench 48 and leading edge cooling holes 46 disposed within leading edge 42 of airfoil 40. Airfoil 40 comprises a thin-walled structure having a hollow cavity that forms cooling channel 56. Airfoil 40 therefore includes external surface 58 and internal surface 60. Cooling hole 46 extends through airfoil 40 from internal surface 60 to external surface 58. Leading edge trench 48 includes first side wall 62A, second side wall 62B and back wall 64. Primary air $A_P$ impinges on blade 32A at leading edge 42, while cooling air $A_C$ is introduced into trench 48 from cooling hole 46. As discussed in the aforementioned U.S. Pat. No. 6,050,777 to Tabitta et al., stagnation point 66, which forms a single point along a stagnation line extending along leading edge 42, moves along the curvature of leading edge 42 for any point along span S depending on the operating state of engine 10 (FIG. 1). The appropriate depth D and width W of trench 48 are thus determined based on testing of particular blades under various operating conditions. For example, width W is typically wider when multiple columns of cooling holes, spaced across width W, are used.

Back wall 64 provides a base connecting side walls 62A and 62B such that trench 48 includes a total width W. As such, back wall 64, side wall 62A and side wall 62B form a single contoured surface through which cooling holes 46 extend in the embodiment shown. Trench 48 is centered on the stagnation line for conditions under which leading edge 42 is subject to the greatest heat. First side wall 62A and second side wall 62B are equally spaced from the stagnation line at those conditions such that back wall 64 is wide enough to envelop the stagnation line for any operating condition of engine 10. Trench 48 is not, however, always centered exactly on the stagnation line due to the variable nature of the stagnation line. In one embodiment, width W is selected to ensure trench 48 will always encompass the stagnation line during different operating states of engine 10. As mentioned above, trench 48 with contoured back wall 64 can also be positioned to envelop multiple columns of cooling holes extending radially along pressure side 50 and suction side 52. Each cooling hole of each column is positioned with respect to the contoured back wall to enhance attachment of cooling air from each hole to back wall 64.

Side walls 62A and 62B are recessed into airfoil 40 such that back wall 64 is a depth D away from stagnation point 66. Depth D of trench 48 is sufficiently deep to allow a recirculation zone of mixed gases to form as a buffer between cooling air $A_C$ and primary air $A_P$ at stagnation point 66. Cooling air $A_C$ from cooling channel 56 tends to flow straight out of cooling hole 46 into trench 48, away from back wall 64 and airfoil 40. Flow of primary air $A_P$ bends the trajectory of cooling air $A_C$ by transferring momentum to the cooling air. The transfer of momentum produces shear on the cooling air, leading to mixing with primary air $A_P$ and a reduction in thin film cooling effectiveness. To improve cooling effectiveness, it is desirable for cooling air $A_C$ to remain against airfoil 40 rather than to mix with primary air $A_P$. In the present invention, back wall 64 is contoured to decrease premature mixing of the cooling air with primary air $A_P$. Specifically, shaping of back wall 64 allows cooling air $A_C$ to remain attached to airfoil 40, thus passing behind the swirling mixture of primary air $A_P$ and cooling air $A_C$.

First side wall 62A and second side wall 62B are shown in FIG. 3 as forming a radius of curvature with back wall 64 and pressure side 50 and suction side 52. However, trench 48 need not have such a contour and can be comprised of angled surfaces in the radial plane shown. Likewise, back wall 64 is shown as having a radius of curvature in the radial plane shown, but may extend linearly, so as to be flat, between side walls 62A and 62B. As discussed with reference to FIG. 4, back wall 64 includes convex protrusions that form undulations between cooling holes 46.

FIG. 4 is a side cross-sectional view of blade 32A of FIG. 3 showing contoured leading edge trench 48 disposed within leading edge 42 of airfoil 40. Trench 48 includes cooling holes 46, back wall 64 and side wall 62A. Cooling holes 46 extend radially outwardly through airfoil 40 from cooling channel 56. Back wall 64 includes undulations that produce concavities 68 and convexities 70. Concavities 68 comprise portions of back wall 64 upstream of exit apertures 71 of cooling holes 46 with respect to flow of cooling air $A_C$. Convexities 70 comprise portions of back wall 64 axially downstream of exit apertures 71 of cooling holes 46 with respect to flow of cooling air $A_C$. As shown, concavities 68 and convexities 70 repeat in a series extending in the radial direction. Thus, adjacent concavities 68 and convexities 70 are displaced a small distance from each other in the radial direction. In embodiments where multiple columns of cooling holes are used, the holes would be aligned with holes 46 in and out of the plane of FIG. 4. In other embodiments, other columns of cooling holes could be staggered radially with respect to holes 46, with contouring of back wall 64 adjusted to place a convexity 70 downstream of cooling air exiting each hole.

Primary air $A_P$ impinges leading edge 42 and flows around pressure side 50 and suction side 52 of airfoil 40. Cooling air $A_C$ is introduced into trench 48 through cooling holes 46. Primary air $A_P$ pushes cooling air $A_C$ onto pressure side 50 and suction side 52 to form a buffer between airfoil 40 and primary air $A_P$. Primary air $A_P$ and cooling air $A_C$ mix within trench 48 where they intersect near stagnation point 66 of the stagnation line (FIG. 3). Trench 48 reduces the amount of force from primary air $A_P$ needed to bend cooling air $A_C$ around airfoil 40, thereby reducing mixing. Contouring of trench 48 maintains cooling air $A_C$ in contact with back wall 64 between holes 46. This prevents detachment of cooling air $A_C$ from back wall 64 at downstream portion 72 (radially outer portions for the described embodiment) of exit apertures 71 of each hole 46 and the formation of recirculation vortex with low heat transfer coefficients. Specifically, convexities 70 form radial extensions of cooling holes 46 that produce a Coanda effect. The Coanda effect produces a stable boundary layer adjacent back wall 64 that causes the jets of cooling air $A_C$ to follow the contour of back wall 64. Attachment of cooling air $A_C$ to back wall 64 inhibits mixing with primary air $A_P$, which improves cooling of airfoil 40.

As depicted in FIG. 4, upstream portions 74 (radially inner portions for the described embodiment) of exit apertures 71 extend to a point that extends primarily in the radial direction with a slight axial component. As such, upstream portions 74 form concavities 68 in the depicted embodiment. However, in other embodiments, exit aperture 71 may comprise a flat portion that extends in a true radial direction at upstream portion 74. Additionally, exit aperture 71 may be rounded rather than being pointed at upstream portion 74. For example, manufacturing limitations may prevent upstream portion 74 from being pointed. FIG. 4 also depicts downstream portion 72 of exit apertures 71 as forming a smooth curve with convexities 70 such that no discernable inflection point is produced. As such, downstream portions 72 align with cooling holes 46 to form a linear extension of the holes. However, in other embodiments, inflection points may be provided such that back wall 64 has an angular profile rather than the wavy profile shown. The desired Coanda effect is attained so long as convexities 70 form protrusions that extend further axially forward than exit apertures 71, to provide a surface or surfaces to which cooling air $A_C$ can attach. Convexities 70 and the protrusions produced thereby are between cooling holes 46 near or adjacent downstream portions 72 to enable cooling air $A_C$ to attach to back wall 64.

The invention makes use of a contoured back wall of the trench configured in such a way as to place a convex curvature directly behind the exit of each of the coolant holes. The boundary layer of the coolant flow is stabilized by the convex curvature, by a principle known as the Coanda effect, causing the jet flow to follow the contour of this back wall and effectively bending the jet back towards the surface of the leading edge, confining it within the trench without the high sheer generated by mixing of the coolant flow with the hot gas path. The contoured back wall will reduce the mixing of the film, improving cooling performance and improving airfoil life, or reducing cooling flow.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A turbine airfoil comprising:

a wall having a leading edge, a trailing edge, a pressure side, a suction side, a tip end, and a root end, an interior surface and an exterior surface;

a cooling channel defined by the interior surface that extends through the wall between the pressure side and the suction side;

a trench extending in a spanwise direction along the exterior surface of the wall and being recessed from the exterior surface towards the interior surface to form a back wall, the back wall being contoured to include at least one undulation; and a plurality of cooling holes extending through the back wall of the trench to place the cooling channel in flow communication with the exterior surface, each cooling hole having a cross-sectional area and a centerline passing through a geometric center of the cross-sectional area, wherein at least one cooling hole is oriented such that a first angle defined between a centerline of the at least one cooling hole and a first tangent of the undulation is less than a second angle defined between the centerline of the at least one cooling hole and a second tangent passing through the undulation at its peak.

2. The turbine airfoil of claim 1 wherein the undulation positions a convex curvature between two of the plurality of cooling holes.

3. The turbine airfoil of claim 2 wherein the undulation positions a concave curvature between adjacent cooling holes and the convex curvature.

4. The turbine airfoil of claim 2 wherein the convex curvature extends further toward the exterior surface of the wall than the plurality of cooling holes.

5. The turbine airfoil of claim 2 wherein at least one of the plurality of cooling holes is angled in the spanwise direction.

6. The turbine airfoil of claim 2 wherein at least one of the plurality of cooling holes extends towards the tip end from the interior surface to the exterior surface.

7. The turbine airfoil of claim 6 wherein the convex curvature is positioned adjacent an exit aperture of one of the plurality of cooling holes toward the tip end.

8. The turbine airfoil of claim 2 wherein the convex curvature forms a smooth extension of one of the plurality of cooling holes.

9. The turbine airfoil of claim 8 wherein a portion of the convex curvature is aligned with an interior portion of one of the plurality of cooling holes.

10. The turbine airfoil of claim 1 wherein the trench comprises:

a first side wall; and a second side wall;

wherein the back wall is recessed from the exterior surface towards the interior surface of the wall by the first and second side walls.

11. The turbine airfoil of claim 10 wherein the first side wall is spaced from the second side wall a width such that the trench is centered on the leading edge of the wall.

12. The turbine airfoil of claim 1 wherein the undulation extends from the back wall towards the exterior surface of the wall such that cooling air leaving each of the plurality of cooling holes attaches along the back wall.

13. The turbine airfoil of claim 1 wherein the trench is disposed along the pressure side or the suction side of the wall.

14. The turbine airfoil of claim 1 and further comprising a plurality of trenches, each trench being contoured to include a series of undulations and having a plurality of cooling holes.

15. The turbine airfoil of claim 1 and wherein the plurality of cooling holes are arranged in a plurality of columns within the trench.

16. The turbine airfoil of claim 1 wherein the at least one cooling hole is substantially parallel to the first tangent of the undulation.

17. An airfoil, comprising:

a body having an external wall surrounding an internal cavity, a spanwise extending leading edge, a spanwise extending trailing edge, a tip end, and a root end;

a trench disposed in the external wall and extending in a spanwise direction, the trench having a first side wall, a second side wall, and a back wall extending between said first and second side walls; and a plurality of cooling apertures disposed within the trench and extending through the external wall to provide a cooling air passage between the internal cavity and the trench;

wherein the back wall is contoured to provide protrusions between adjacent cooling apertures, and wherein each of the plurality of cooling apertures has a cross-sectional area and a centerline passing through a geometric center of the cross-sectional area, and wherein at least one cooling aperture is oriented such that the centerline of the at least one cooing aperture is substantially parallel to a tangent of an adjacent protrusion.

18. The airfoil of claim 17 wherein the contoured back wall includes a series of undulations extending in the spanwise direction along the trench.

19. The airfoil of claim 17 wherein the contoured back wall includes convex curvatures extending from an interior of at least one of the plurality of cooling apertures.

20. The airfoil of claim 17 wherein at least one of the cooling apertures is angled in the spanwise direction, the cooling aperture extending from the internal cavity to the trench.

21. The airfoil of claim 20 wherein the protrusions are positioned adjacent exits of the plurality of cooling apertures toward the tip end.

22. The airfoil of claim 16 wherein the protrusions extend towards the exterior wall to which cooling air leaving each of the plurality of cooling apertures attaches to the back wall.

23. The airfoil of claim 17 wherein the trench is disposed along the leading edge.

24. The airfoil of claim 17 wherein the external wall includes a plurality of trenches extending in the spanwise direction of the airfoil, each trench including a plurality of cooling apertures positioned along the back wall of the trench.

25. The airfoil of claim 17 wherein the plurality of cooling apertures includes multiple columns of cooling apertures extending in the spanwise direction along the back wall.

26. A hollow airfoil comprising:

an external surface having a suction side, a pressure side, a leading edge, a trailing edge, a tip end, and a root end so as to form the airfoil;

an internal cavity extending through the airfoil and into which cooling air is flowable from the root end of the airfoil;

a trench disposed in the external surface and extending spanwise along the leading edge;

a plurality of cooling holes extending from the internal cavity towards the tip end and through to the external surface within the trench, wherein each of the plurality of cooling holes has a cross-sectional area and a centerline passing through the geometric center of the cross-sectional area; and a plurality of convexities positioned in the trench adjacent a side of the cooling holes opposite the root end, wherein at least one cooling hole is oriented such that the centerline of the at least one cooling hole is substantially parallel to a tangent of at least one of the convexities.

27. The hollow airfoil of claim 26 wherein the plurality of convexities extend from a back wall of the trench towards the external surface such that cooling air leaving the plurality of cooling holes attaches to the plurality of convexities using a Coanda effect.

28. The hollow airfoil of claim 26 wherein the plurality of convexities form a series of undulations that are displaced in a spanwise direction from each other.

29. The hollow airfoil of claim 26 wherein the plurality of convexities form smooth extensions of the plurality of cooling holes in a direction of flow of the cooling air.

* * * * *